US011345163B2

(12) United States Patent
Tori et al.

(10) Patent No.: US 11,345,163 B2
(45) Date of Patent: May 31, 2022

(54) INK DELIVERY SYSTEM FOR A PRINTING MODULE AND METHOD FOR DELIVERING INK

(71) Applicant: SICPA HOLDING SA, Prilly (CH)

(72) Inventors: Silvano Tori, Chiaverano (IT); Alessandro Scardovi, Ivrea (IT); Tazio Sandri, Verona (IT); Marco Sarti, Turin (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 17/265,030

(22) PCT Filed: Jul. 15, 2019

(86) PCT No.: PCT/EP2019/069011
§ 371 (c)(1),
(2) Date: Feb. 1, 2021

(87) PCT Pub. No.: WO2020/025305
PCT Pub. Date: Feb. 6, 2020

(65) Prior Publication Data

US 2021/0347183 A1 Nov. 11, 2021

(30) Foreign Application Priority Data

Jul. 30, 2018 (EP) ..... 18186278

(51) Int. Cl.
*B41J 2/19* (2006.01)
*B41J 2/175* (2006.01)
*B41J 2/18* (2006.01)

(52) U.S. Cl.
CPC ..... *B41J 2/19* (2013.01); *B41J 2/17566* (2013.01); *B41J 2/18* (2013.01)

(58) Field of Classification Search
CPC ... B41J 2/19; B41J 2/18; B41J 2/17556; B41J 2/175; B41J 2/17566; B41J 2/16517
See application file for complete search history.

(56) References Cited

U.S. PATENT DOCUMENTS 8,534,807 B2 * 9/2013 Hoisington ..... B41J 2/14233 347/89
9,272,523 B2 3/2016 Sanaei et al.
(Continued)

FOREIGN PATENT DOCUMENTS

EP 1831025 A1 9/2007
EP 2516167 A1 10/2012
(Continued)

OTHER PUBLICATIONS

International Search Report and Written Opinion issued with respect to application No. PCT/EP2019/069011.
(Continued)

*Primary Examiner* — An H Do
(74) *Attorney, Agent, or Firm* — Muncy, Geissler, Olds & Lowe, P.C.

(57) ABSTRACT

An ink delivery system for at least one printing module comprising a closed-loop ink recirculation circuit and a vacuum discharge circuit, which is configured to produce a vacuum condition in the at least one printing module. A method for delivering ink to the at least one printing module is also disclosed.

14 Claims, 4 Drawing Sheets

(56) References Cited

U.S. PATENT DOCUMENTS

| | | | | |
|---|---|---|---|---|
| 10,899,136 | B2 * | 1/2021 | Butinya | B41J 2/18 |
| 2009/0040249 | A1 | 2/2009 | Wouters et al. | |
| 2010/0039460 | A1 | 2/2010 | Delueg | |
| 2011/0242156 | A1 | 10/2011 | Shimoda | |
| 2012/0299989 | A1 | 11/2012 | Prothon et al. | |
| 2015/0283819 | A1 | 10/2015 | Sanaei et al. | |
| 2015/0283820 | A1 | 10/2015 | Esdaille-Watts et al. | |

FOREIGN PATENT DOCUMENTS

| | | | |
|---|---|---|---|
| EP | 2834073 | A1 | 2/2015 |
| JP | 2016-010786 | A | 1/2016 |
| WO | 2013/150396 | A1 | 10/2013 |
| WO | 2017/064665 | A1 | 4/2017 |

OTHER PUBLICATIONS

International Preliminary Report on Patentability issued with respect to application No. PCT/EP2019/069011.

* cited by examiner

INK DELIVERY SYSTEM FOR A PRINTING MODULE AND METHOD FOR DELIVERING INK

TECHNICAL FIELD

The present invention relates to technical field of a printing technology, in particular to an ink delivery system for a printing module and to a method for delivering ink to a printing module.

BACKGROUND ART

Many solutions of ink delivery systems for printing modules are known in the art. They operate either in an open environment (i.e. the ink surface is directly exposed to the room air) or in closed environment (the ink in the feeding circuit does not communicate directly with the room air). The latter solution is suitable for solvent based inks, which vapor can be hazardous to the health. Also, the ink delivery system can be provided with a stirrer or another suitable mixing equipment able to keep uniform the distribution of the ink components within the fluid. This is particularly advantageous when pigmented inks are used.

However, when pigmented inks are used, the precipitation of the pigments might be a possible issue, mainly when the pigment size is large. Ink recirculation is desirably accomplished through a closed-loop fluidic circuit. Substantially, a feeding pipe brings the ink from a container to the print modules and a return pipe collects the ink from the modules, leading it back to the container. Therefore, the ink undergoes continuous movement, caused by a circulation pump, which enhances the mixing of the components, reducing in turn the possible precipitation of the pigments.

The flow induced mixing cannot take place in an open-loop fluidic circuit, with the sole feeding pipe connecting the ink container to the print module. In this case the ink flow is produced during the restoration of the volume of liquid ejected in the printing operation; the flow rate turns out to be very low and can hardly contribute to the effective mixing of the liquid. On the contrary, in a recirculating closed-loop circuit the flow rate produced by the circulation pump can be substantially larger than the ink ejection rate during the printing and the resulting mixing of the liquid is much more effective.

U.S. Pat. No. 9,272,523 B2 and US20150283820 A1 both describe ink delivery systems, which generally comprise a closed loop fluidic circuit having first and second ink conduits interconnecting an ink container with respective first and second ink ports of the printhead. A reversible pump is positioned in the second ink conduit for pumping ink around the closed loop. In U.S. Pat. No. 9,272,523 B2 the first and second pumps are employed for pressurized priming of the printhead so as to optimize a pressure gradient along a length of the printhead. In US20150283820 A1, in order to improve the efficiency of air bubble purging and minimize printer "wake-up" times, a flow speed of ink through the downstream ink conduit is made greater than a flow speed of ink through the upstream first conduit. JP 2016 010786 A describes another ink delivery system wherein a circulation passage of an ink to an inkjet head basically comprises: an ink supply tank, a supply passage and a return passage of the ink, which interconnect the supply tank and the ink jet head; and a circulation pump provided on the return passage. The system further comprises a control tank for storing the ink, connected to the return passage, a negative pressure generation means for generating negative pressure which is applied to the control tank, for generating the meniscus pressure at the nozzle of the inkjet head; an ink refilling tank connected with the supply tank through supply pump and valve; and an atmospheric air flow passage communicating with the supply tank via an air release valve.

However, the efficient ink delivery system must ensure the adequate and continuous ink flow at all printing conditions, meanwhile keeping the backpressure in the printing modules within a narrow range around its optimum value, in spite of the pressure drop along the length of the ink pipes connecting the ink reservoir with the printing module.

The currently available systems often show poor performances with respect to backpressure control and flow uniformity.

It is therefore an object of the present invention to overcome the shortcomings of the prior art and to provide a simple and effective ink delivery system, which will ensure a regular ink flow and a good control of the backpressure, whose fluctuation is kept very low, giving in turn uniform performances during printing, using a lesser number of items like pumps and sensors, providing replenishment of the fluidic circuit as well as the printing modules with a nearly complete elimination of the air from the ink and the subsequent reduction of clogging during the printing, thus in overall improving the reliability of the printing equipment.

Another object of the invention is to provide a respective method for delivering ink to a printing module, which ensures achievement of the above-mentioned advantageous effects.

SUMMARY OF THE INVENTION

According to one aspect, the present invention relates to an ink delivery system for at least one printing module, the system comprising a closed-loop ink recirculation circuit, the ink recirculation circuit comprising:

a pressure regulating chamber;

a first ink conduit configured to supply an ink from the pressure regulating chamber to the at least one printing module;

a second ink conduit configured to collect the ink from the at least one printing module and to return the collected ink to the pressure regulating chamber; and a recirculation pump arranged in the second ink conduit;

wherein the ink delivery system further comprises a vacuum discharge circuit connected to the second ink conduit through a valve, the vacuum discharge circuit configured to produce a vacuum condition in the at least one printing module.

The vacuum discharge circuit produces a vacuum condition in the printing modules during the starting ink filling phase, preventing the formation of air bubbles in the liquid which can obstruct the narrow flow channels of the ejection device. Accordingly, the presence of the vacuum discharge circuit guarantees a higher reliability of the printing.

According to one aspect of the invention, the vacuum discharge circuit comprises a vacuum pump and a Pirani vacuum sensor, which allows the circuit replenishment under vacuum conditions. This method is much more effective than the commonly adopted filling procedure, which is carried out with a purging sequence and entails unavoidably a long over-drooling.

Preferably, the vacuum discharge circuit comprises an ink trap arranged upstream of the vacuum pump for collecting residual ink, if any, and providing additional safety.

According to a further aspect of the invention, the ink delivery system further comprises a first ink manifold in the first ink conduit and a second ink manifold in the second ink conduit of the recirculation circuit. In this embodiment, the vacuum discharge circuit is further configured to create a vacuum condition in the second manifold and in a part of the second ink conduit.

According to a further aspect of the invention, the ink delivery system further comprises a backpressure generating circuit configured to connect the pressure regulating chamber with an external environment through an adjustable needle valve. The backpressure generating circuit can further comprise a backpressure pump configured to maintain established backpressure in the pressure regulating chamber.

According to a further aspect of the invention, the ink delivery system further comprises a third ink conduit interconnecting the pressure regulating chamber and an ink tank, and a refilling pump arranged in the third ink conduit. In this embodiment, the refilling pump is configured to restore an ink level in the pressure regulating chamber.

According to a further aspect of the invention, the ink delivery system further comprises a pressure sensor arranged in an upper part of the pressure regulating chamber.

According to a further aspect of the invention, the ink delivery system further comprises a speed sensor arranged in the ink recirculation circuit.

According to a further aspect of the invention, the ink delivery system further comprises a liquid level sensor arranged in the pressure regulating chamber.

According to a further aspect of the invention, the ink delivery system further comprises ancillary means selected from insulation valves, stirring means, a purging circuit, an ink waste tank, a cleaning liquid tank and a filtering unit.

According to a further aspect of the invention, the ink delivery system further comprises a degassing cartridge arranged in the first ink conduit or in the second ink conduit of the recirculation circuit to extract dissolved gases from the ink. The degassing cartridge can comprise a degassing pump and a vacuum sensor.

According to a further aspect of the invention, the first ink manifold has a single fluidic connection or a double fluidic connection with an ink tank.

According to another aspect of the invention, a method for delivering ink to at least one printing module comprises:

providing an ink delivery system as hereinbefore described;

providing a continuous flow of the ink in a closed-loop ink recirculation circuit of the ink delivery system;

producing, by a vacuum discharge circuit, a vacuum condition in the at least one printing module.

According to a further aspect of the invention, the method comprises maintaining established backpressure in a pressure regulating chamber of the ink delivery system.

The present invention will be described more fully hereinafter with reference to the accompanying drawings in which same numerals represent same elements throughout the different figures, and in which prominent aspects and features of the invention are illustrated.

DETAILED DESCRIPTION

Figure 1:
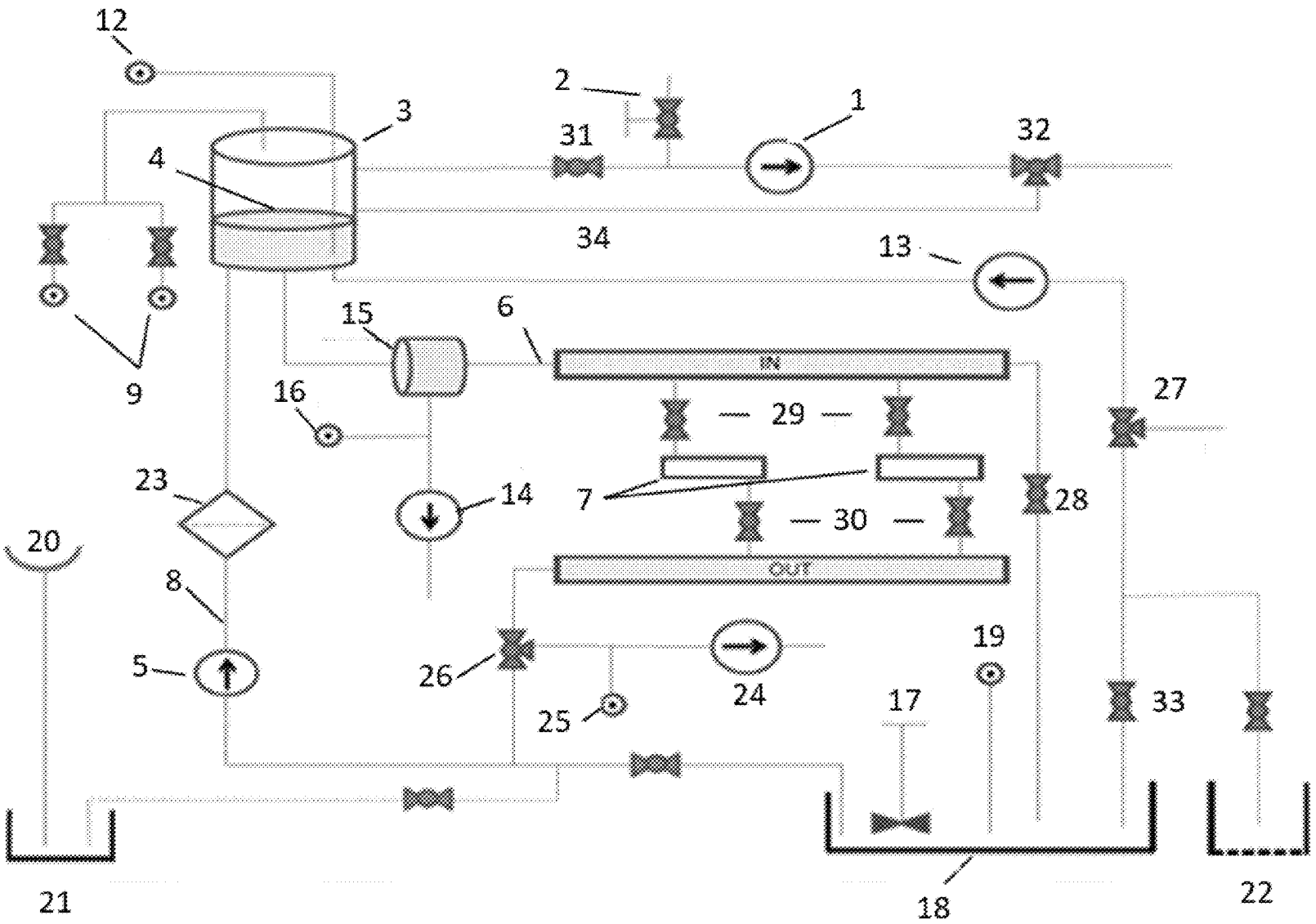
FIG. 1 is a schematic illustration of the ink delivery system according to the first embodiment of the present invention.

Referring to FIG. 1, an ink delivery system for supplying ink to a printhead is shown schematically.

The ink delivery system comprises a pressure regulating chamber 3, acting both as a damper and a pressure regulator, by means of a backpressure pump 1 and the needle valve 2; a recirculating pump 5, which moves the ink along the fluidic circuit and meanwhile implements the ink mixing, preventing the particulate precipitation; a refilling pump 13 to restore the ink level 4 in the pressure regulating chamber 3, compensating for the liquid lost during printing. Ancillary items like, inter alia, stirring equipment or stirrer 17 is also present in the ink delivery system. A suitable degassing cartridge 15 is fitted into first ink conduit 6 to extract possible dissolved gases (air) from the ink.

The pressure regulating chamber 3 has the aim to guarantee a certain level of depression with respect to the external atmospheric pressure, which should be as stable as possible throughout all the printing modules. The actual magnitude of such a depression is rather low, compared to the atmospheric pressure. Generally, few tens of mm $H_2O$. Nevertheless, this depression is necessary for the correct functioning of the printing system, either of a single print head or a multichip printing module. The stability in time of such a backpressure, which should be hardly affected by the printing rate, can guarantee the constant performance during the ink ejection. In fact, large unwanted fluctuations in the backpressure level may cause a big spread in the drop volume as well as in the refilling time of the ejection chambers, degrading the overall performance of the printing system which can even undergo some drooling from the nozzles, in the worst case.

The pressure regulating chamber 3 is a closed container, filled only partially with the ink. The pressure regulating chamber is connected with the external environment (atmospheric pressure) through an adjustable needle valve 2; in addition, in parallel with the needle valve 2 there is a backpressure pump 1. When it is switched on, it produces a certain depression across the needle valve 2 and establishes therefore a depression also into the pressure regulating chamber 3. In static conditions, i.e. when the volume of the ink in the pressure regulating chamber 3 does not change, the evacuation rate of the backpressure pump 1 and the adjustment of the needle valve 2 determine a certain equilibrium value of the internal pressure. Modifying the needle valve 2 setting or the backpressure pump 1 evacuation rate, such a value can be changed in turn.

The ink can be fed to the print module, through a pipe connected to the bottom of the pressure regulating chamber 3, in the portion occupied by the liquid. The ink ejection causes a reduction of the ink level in the pressure regulating chamber 3, which causes in turn a reduction of the pressure of the gas above the liquid surface, due to the increased gas volume. The pressure reduction perturbs the equilibrium state and causes an increasing in the air flow from the external environment through the needle valve 2.

If a small amount of liquid was suddenly extracted from the pressure regulating chamber in a finite time interval, the pressure level would be restored to the original value with a certain time constant, depending on the physical parameters of the system. On the contrary, if an enduring ink flow takes place due to the printing activity, the stronger the flow rate, the lower is the pressure into the pressure regulating chamber 3. In this case, the original stable pressure level cannot be reached, until the ink flow stops.

To compensate for this effect and, in general, to stabilize the pumping system against possible fluctuations, a suitable feedback is applied to the backpressure pump, through pressure sensors 9 in the upper part of the pressure regulating chamber 3; the backpressure pump speed is changed depending on to the pressure variation in the pressure regulating chamber as a function of the difference with a preset reference level, in order to maintain the original internal pressure.

Figure 2:
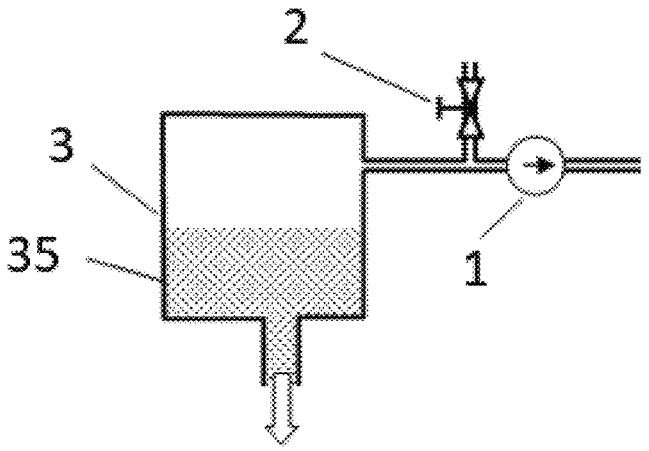
FIG. 2 illustrates a fluidic circuit around the pressure regulating chamber of the ink delivery system and its basic components.

The fluidic circuit around the pressure regulating chamber 3, with its basic components, is illustrated on FIG. 2, depicting the pressure regulating chamber 3 with ink 35, the backpressure pump 1, the needle valve 2 and ink flow to the print head shown with the down arrow.

Figure 3:
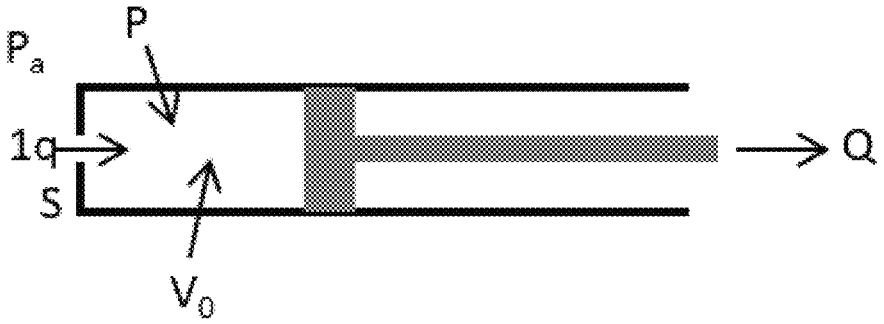
FIG. 3 illustrates a simple model, which allows to evaluate the pressure change of the gas inside the pressure regulating chamber as a function of the change in volume of the liquid.

To evaluate the pressure change of the gas inside the pressure regulating chamber 3 as a function of the change in volume of the liquid, a simple model can be adopted, depicted in FIG. 3.

The change of the volume of liquid inside the pressure regulating chamber 3, due to the ink flow caused by the ejection, can be simulated by the movement of the piston along the cylinder axis, which in turn represents the gas-liquid interface. The rate of the volume change corresponds to an ink flow rate Q=dV/dt. On the other side, the pressure difference between the external value Pa (Pa=atmospheric pressure) and the internal cylinder pressure P (P<Pa due to the established backpressure) will cause an air flow inwards, which is counter-balanced by the backpressure pump 1. Over time, a net gas volume w flows into the pressure regulating chamber 3 (the gas volume w is evaluated at the reference atmospheric pressure Pa); the net gas flow rate into the cylinder is q=dw/dt. The difference between the internal pressure P and the atmospheric pressure Pa can change during the time, due to both the entered gas volume w and the change of internal volume $\Delta V=V-V_0$ caused by the ink flow; the variation trend can be inferred taking in account the total number of moles of gas inside the cylinder and the actual gas volume V. Assuming that the difference between P and Pa is very small, we get the approximate expression:

$$P-Pa \approx Pa\cdot(w-\Delta V)/V$$

The above formula can be used to effectively evaluate the response of the pressure control system to the volume change due to ink ejection, although more sophisticated numerical simulations could be performed.

To achieve some predetermined backpressure at the print modules, suitable for the proper working of the printing device, both the hydrostatic and the dynamic pressure drops must be taken in account, besides the backpressure in the pressure regulating chamber 3.

Figure 4A:
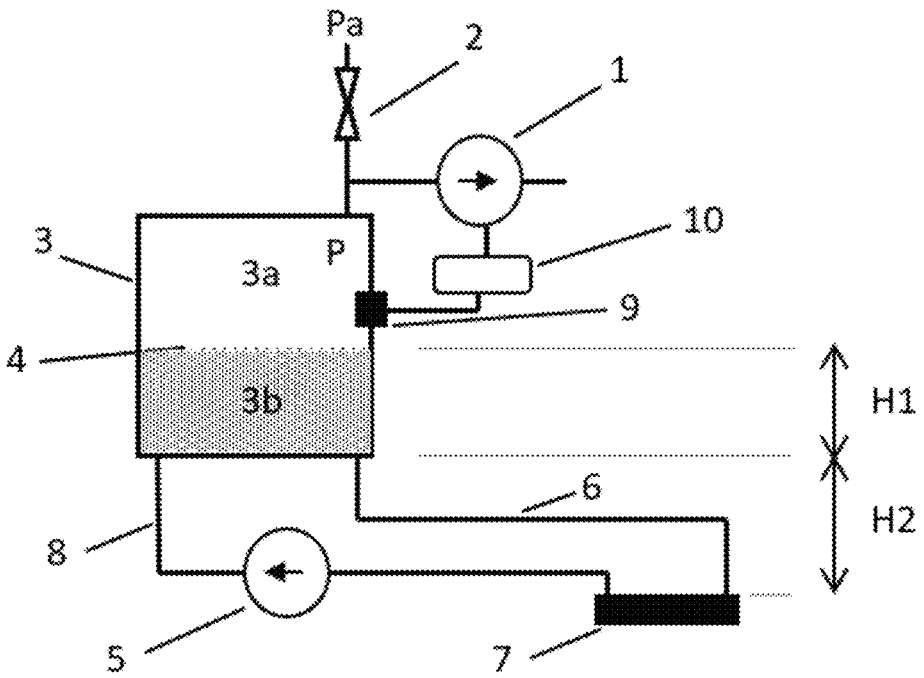
FIG. 4*a* provides a more detailed illustration of the fluidic circuit, even if still simplified, where the ink recirculation circuit is also taken in account and therefore also the return duct is depicted.

A more detailed illustration of the fluidic circuit, even if still simplified, is provided in FIG. 4*a*, where also the ink recirculation circuit is taken in account and therefore also the return duct is depicted.

As shown in FIG. 4*a*, by means of the backpressure pump 1 and the needle valve 2 a pressure P, lower than the atmospheric pressure, is generated in the upper part 3*a* of the pressure regulating chamber 3, whilst the lower part 3*b* is filled by the liquid ink. The boundary between the two parts of the pressure regulating chamber 3 is represented by the liquid ink surface (liquid ink level) 4. The recirculation pump 5 moves the liquid ink to and from the printing module 7, through the first ink conduit 6 and the second ink conduit 8, to reduce the risk of pigment precipitation. The pressure sensor 9 of the pressure regulating chamber 3 and the feedback circuit 10, complete the fluidic circuit illustration.

The printing module requires a suitable backpressure in the neighboring ink, to be able to operate properly. According to the general laws of fluids, the ink pressure in the module is due to the contribution of several elements: the pressure P in the upper part of the pressure regulating chamber 3, which is lower than the atmospheric pressure Pa; the hydrostatic pressure due to the liquid height H1, from the liquid ink surface 4 and the bottom of the pressure regulating chamber 3; the hydrostatic pressure due to the liquid height H2, from the bottom of the pressure regulating chamber 3 and the printing module; the dynamical pressure drop caused by the dissipative ink flow from the pressure regulating chamber 3 to the printing module through the first ink conduit 6 of the recirculation circuit. Whilst the hydrostatic pressure due to H1 and H2 gives a positive contribution to the total pressure at the printing module, the dynamical pressure drop due to the ink flow gives a negative contribution to the total pressure Pt, which turns out to be:

$$Pt=P+P(H1)+P(H2)+P(\text{flow})$$

where all the pressure elements are assumed with their own algebraic sign. The values of P, H1, H2 and P(flow) must be chosen properly, in order that the total pressure Pt remains lower than the atmospheric pressure Pa and within a pressure range where the printing module can operate properly. Particularly, the pressure increase due to H1 and H2 should not be too large, otherwise it could be impossible to keep the total pressure Pt lower than Pa, even with the contribution of P and P(flow).

Figure 4B:
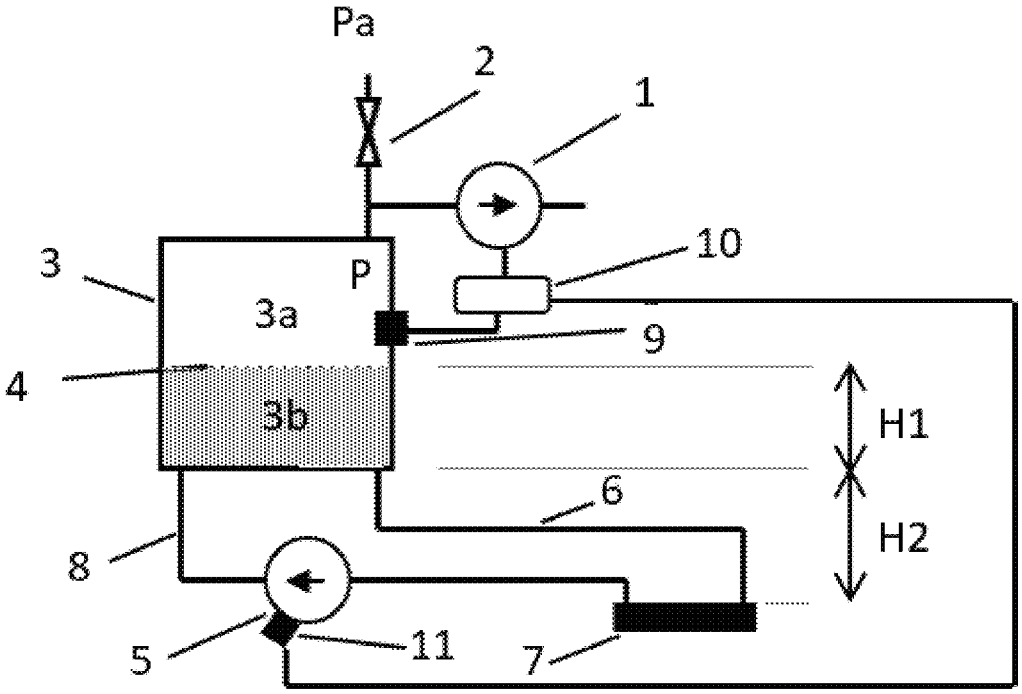
FIG. 4*b* provides an illustration of the fluidic circuit wherein a suitable speed sensor is applied to the recirculation pump.

A further improvement of the system can be introduced, taking in account that the backpressure pump and the recirculation pump cannot actually reach their preset pumping capacity at the same time, for any reason, either intentionally or accidentally. When the recirculation pump 5 is working at a pumping capacity that is lower than its operational level, there is a reduction of the pressure drop across the first ink conduit 6, i.e. the pressure in the printing modules turns out to be higher than the operational expected value. Depending on the actual embodiment of the ink delivery system as well as on the detailed sequence of the operating procedure of the controller, either the backpressure pump 1 or the recirculation pump 5 could be switched on in advance. In order to stabilize the pressure level at the printing modules, whatever the sequence of the pump starting, a suitable speed sensor 11 can be applied to the recirculation pump and its signal can be opportunely introduced in feedback circuit 10 of the backpressure pump. When the speed of the recirculation pump is still low or zero, the speed of the backpressure pump can be increased so as to cause a larger backpressure in the pressure regulating chamber 3 itself, to compensate the lack of drop pressure in the first ink conduit 6; on the contrary, when the recirculation speed gets its steady-state, the feedback circuit is set so as to adjust the backpressure pump speed at a lower value, suitable to obtain the wanted backpressure in the pressure regulating chamber 3. Such a feature provides a greater flexibility in the operating procedure, since pressure fluctuations can be easily compensated. This implementation is illustrated in FIG. 4*b*.

Moreover, when the printing module is actually ejecting ink during its operation, more liquid is drawn from the first ink conduit 6, besides the normal recirculation flow, increasing the pressure drop across the ink conduit; the ejection causes also a progressive decreasing in the liquid level in the pressure regulating chamber, as mentioned previously. These two effects contribute to decrease even more the pressure at the printing module. The rate of the ejected liquid depends on the number of activated ejectors, on the drop volume and on the repetition rate. For example, in a common industrial print bar operating at the resolution of 300 dpi with a swath length of 20 inches, the flow rate of the ejected ink can be greater than 60 cc/minute, but it could be reduced if a lesser optical density is required on the medium. A suitable liquid level sensor 12 in the pressure regulating chamber 3 (see FIG. 1) enables a fill pump 13 to restore the liquid in the pressure regulating chamber when it is necessary. However, the actual pressure at the printing module is subject to fluctuation during the operation and must be kept within an operational range to ensure the correct performance.

The proper backpressure value (i.e. the difference from the atmospheric pressure and the pressure at the printing module) is preferably in the range from about 50 mm $H_2O$ to about 130 mm $H_2O$ and most preferably in the range from about 70 mm $H_2O$ to about 110 mm $H_2O$. Within the proper operational range, the printing performance remains stable, allowing the system to follow the printing trend and to replace the ejected liquid, without compromising the print quality.

The ink delivery system according to the invention can be completed by a degassing cartridge 15, purged by a suitable degassing pump 14 provided with a vacuum sensor 16; by a mechanical or even ultrasonic stirrer 17, useful in case of pigmented inks, that moves the liquid into the ink tank 18, provided with its own level sensor 19; by suitable valves placed along the various parts of the fluidic circuit, that enable the automatic control of the ink delivery system features.

Other ancillary means can be introduced into the ink delivery system without departing from the core of the invention. A capping device 20 and an ink waste tank 21, which collects the ink during the purging phase; a cleaning liquid tank 22, from which the cleaning liquid can be circulated along the fluidic circuit; a filtering unit 23 fitted in the recirculation circuit.

To guarantee a higher reliability of the printing, the ink delivery system comprises a vacuum discharge circuit, which produces a vacuum condition in the printing modules during the starting ink filling phase, preventing the formation of air bubbles in the liquid which could obstruct the narrow flow channels of the ejection device. It consists of a vacuum pump 24, provided with a Pirani vacuum sensor 25; the pump is connected to the recirculation circuit through the valve 26 and allows the circuit replenishment under vacuum conditions. This method is much more effective than the commonly adopted filling procedure, which is carried out with a purging sequence and entails unavoidably a long over-drooling.

In more detail, the ink filling phase can be done according to the following sequence. At first, the pressure regulating chamber 3 is loaded with ink. This is realized switching on the refilling pump 13, opening the valve 33 and configuring the valve 27 so as to put the ink tank 18 and the pressure regulating chamber 3 in communication, whilst the valve 32 is set to allow the venting of the pressure regulating chamber to atmosphere. Subsequently, the first ink manifold (or the IN manifold) is filled with liquid through the first ink conduit 6. The ink is sucked from the ink tank 18 through the valves 33 and 27 and is driven by the same pump 13 into the pressure regulating chamber 3, whose venting path through the valve 32 has been closed; from the bottom of the pressure regulating chamber the ink flows through the first ink conduit 6, fills the IN manifold and drops down into the ink tank through the valve 28, suitably opened. Finally, the pump 13 is switched off, and the communication with the ink tank 18 is shut closing the valves 27, 28 and 33. During these phases, the printing module valves 29 and 30 are kept closed.

At this point the vacuum condition is created in the printing modules, in the second ink manifold (or OUT manifold) and in a part of the second ink conduit 8. To this purpose, it is necessary that the exit nozzles of the printing modules have been previously shut with a suitable capping device 20. It is a movable item that can be brought in contact with the nozzle surface, so as to prevent any fluidic communication from the inner space of the modules and the external environment or removed from there before starting the print. Subsequently, the valves 30 are opened and the 3-way valve 26 is configured, so as to close the downstream portion of the recirculation circuit comprising the second ink conduit but leave open the communication with the vacuum pump 24. Switching on the vacuum pump 24, the vacuum condition is created into the modules and into the return portion of the circuit up till the valve 26. After that, the valves 30 are closed.

In the subsequent phase, the filling of the printing modules with ink through the first ink conduit 6 and the IN manifold takes place. The pressure regulating chamber is vented to the atmosphere, as described above, and the valves 30 downstream of the modules remain closed. Opening the valves 29 the liquid is pushed by the atmospheric as well as the hydrostatic pressure from the IN manifold into the modules. Since the modules have been previously evacuated, no resistance is substantially opposed during the filling phase and the liquid can penetrate thoroughly into the fluidic circuitry of the printing modules. Only the residual pressure after evacuation could make a small amount of air concentrate near the exit side of the ink. However, during the normal printing operation, after removing the capping device 20 the ink would fill spontaneously and completely the nozzles, due to the capillary effect. The module filling can be done at once or one by one. In the latter case only one of the valves 30 is closed at a time and only one of the valves 29 is open, to fill a single module. The vacuum pump 24 is maintained switched on, to guarantee the vacuum condition in the other modules. Some ink refilling can be necessary, to bring the liquid in the pressure regulating chamber back to its original level. This can be done operating suitably pump and valves, according to the mentioned procedure.

At this point, the circulation of the ink is started, switching on the recirculation pump 5, keeping open the valves 29 and opening the valves 30 to put the modules in communication with both the IN and the OUT manifolds and configuring the 3-way valve 26 so as to open the fluidic path towards the second ink conduit 8 of the recirculation circuit, closing instead any communication path with the vacuum pump 24. The initial vacuum condition in the OUT manifold promotes the ink flow from the modules into the OUT manifold; the pump 5 removes some residual air in the short duct between the valve 26 and the circulation pump 5 allowing the ink to fill completely the recirculation circuit. Meanwhile, the 3-way valve 32 is configured to close the duct 34, opening in turn a way out to the air for the backpressure pump 1. Further, the valve 31 is opened and the backpressure pump 1 is switched on, producing the suitable operating backpressure in the pressure regulating chamber 3. When finally, the capping device 20 is removed from the front of the printing modules, the system is ready for the operation.

In order to guarantee the correct evacuation of the ducts as well as the predictable fluid flow, without any issue, suitable delay times are set in the opening and closing sequence of the valves.

When the system has to be purged or emptied of ink, the pressure regulating chamber can act as a generator of overpressure, to promote the quick and complete flowing out of the liquid ink. For this purpose, the overpressure condition is created in the pressure regulating chamber 3 according to the following procedure: the valve 31 is closed, the needle valve 2 is left open and the 3-way valve 32 is configured so as to put the backpressure pump 1 in communication with the pressure regulating chamber, via the duct 34. Switching on the backpressure pump 1 produces an overpressure in the pressure regulating chamber 3, which is transferred to the downstream circuit and acts as an additional driving force.

Other embodiments of the ink delivery system can be realized according to the same concepts described above as depicted in FIG. 5.

Figure 5:
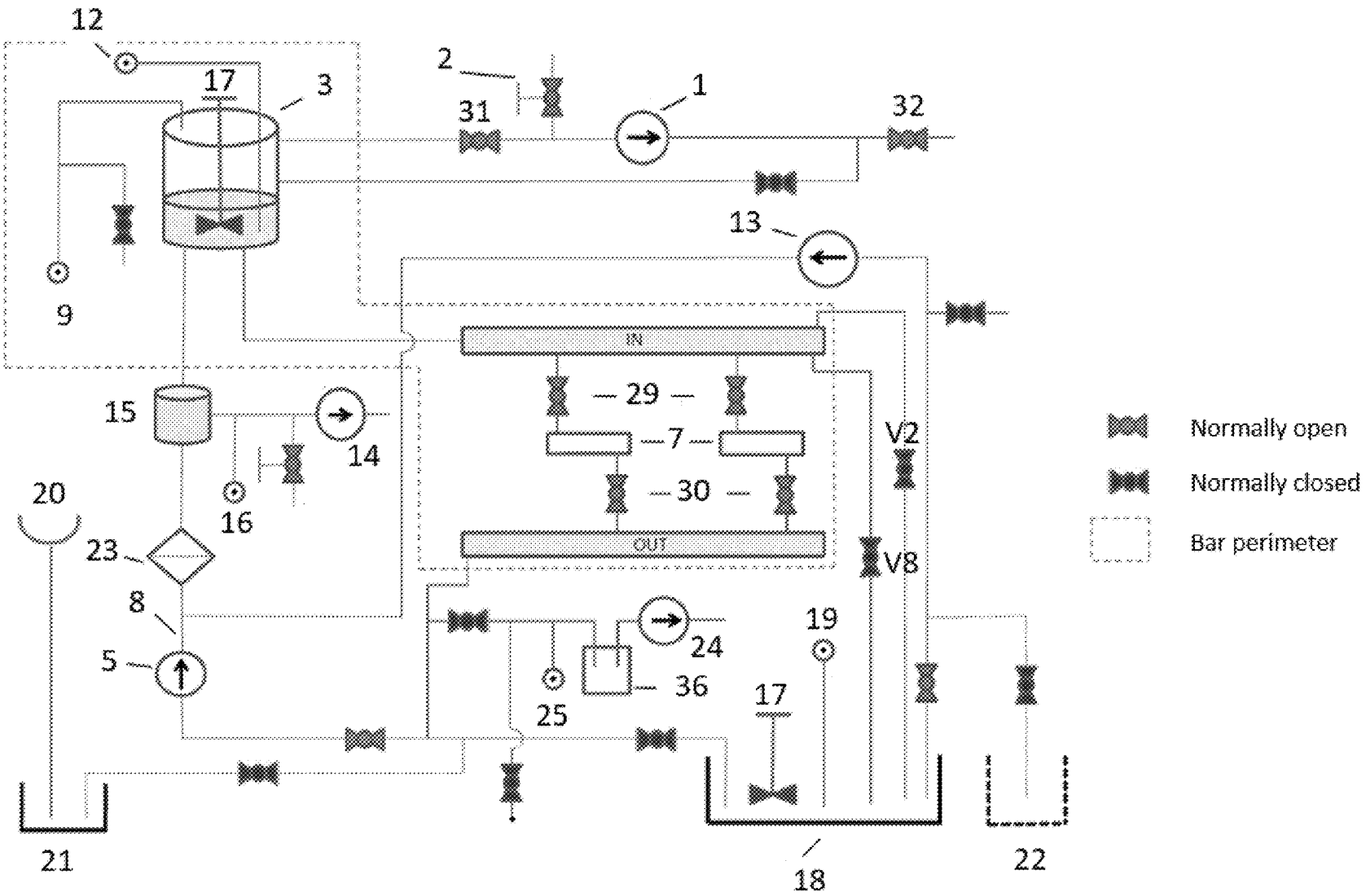
FIG. 5 provides a schematic illustration of the ink delivery system according to the second embodiment of the present invention.

In this second embodiment there is not any 3-way valves. Instead, a plurality of standard 2-way valves are suitably placed in the fluidic circuit to perform all the described operations. The degassing cartridge has been placed in the second ink conduit of the ink delivery system, contrary to the first embodiment, where the degassing cartridge was placed in the first ink conduit of the ink delivery system. The IN manifold has a double fluidic connection with the ink tank, through the valves V2 and V8, instead of the single pipe of the first embodiment. The purpose of this feature is to use the right pipe in the filling phase, because it starts from the top of the manifold, ensuring the complete replenishment of the item; on the contrary, when the ink has to be removed from the manifold, e.g. for servicing, the left pipe is used, since it starts from the bottom of the manifold and thus ensures that the item gets completely empty. In this way, the full control of the manifold state is ensured, without the need to use a dedicated sensor and a feedback to the pump. Moreover, an additional ink trap 36 has been placed in the evacuation circuit, upstream of the vacuum pump 24, for the sake of safety. A plurality of other sets of printing modules could be connected to the same evacuation circuit, avoiding the duplication of the pumping equipment. In FIG. 5 a second module set (not depicted) can be brought in communication with the evacuation circuit via the conduit and the valve.

The proposed solution for the ink delivery system according to the invention turns out to be simple and effective.

Compared with other commercially available ink delivery systems, the present invention adopts a lesser number of parts like pumps and sensors, providing however good performances. The present invention ensures a regular ink flow and a good control of the backpressure, whose fluctuation is kept very low, giving in turn uniform performances during printing. It provides replenishment of the fluidic circuit as well as the printing modules with a nearly complete elimination of the air from the ink and the subsequent reduction of clogging during the printing, thus in overall improving the reliability of the printing equipment.

The above disclosed subject matter is to be considered illustrative, and not restrictive, and serves to provide a better understanding of the inventions defined by the independent claims.

The invention claimed is:

1. An ink delivery system for at least one printing module, the system comprising a closed-loop ink recirculation circuit, the ink recirculation circuit comprising:

a pressure regulating chamber;

a first ink conduit configured to supply an ink from the pressure regulating chamber to the at least one printing module;

a second ink conduit configured to collect the ink from the at least one printing module and to return the collected ink to the pressure regulating chamber; and a recirculation pump arranged in the second ink conduit;

wherein the ink delivery system further comprises a vacuum discharge circuit connected to the second ink conduit through a valve, the vacuum discharge circuit configured to produce a vacuum condition in the at least one printing module, and the ink delivery system further comprises a backpressure generating circuit configured to connect the pressure regulating chamber with an external environment through an adjustable needle valve, characterized in that the backpressure generating circuit further comprises in parallel with the needle valve a backpressure pump configured to maintain established backpressure in the pressure regulating chamber.

2. The system according to claim 1, further comprising a first ink manifold in the first ink conduit and a second ink manifold in the second ink conduit of the recirculation circuit.

3. The system according to claim 2, wherein the vacuum discharge circuit is further configured to create a vacuum condition in the second manifold and in a part of the second ink conduit.

4. The system according to claim 2, wherein the first ink manifold has a single fluidic connection or a double fluidic connection with an ink tank.

5. The system according to claim 1, wherein the vacuum discharge circuit comprises a vacuum pump and a Pirani vacuum sensor.

6. The system according to claim 5, wherein the vacuum discharge circuit comprises an ink trap arranged upstream of the vacuum pump.

7. The system according to claim 1, further comprising a third ink conduit interconnecting the pressure regulating chamber and an ink tank, and a refilling pump arranged in the third ink conduit, the refilling pump configured to restore an ink level in the pressure regulating chamber.

8. The system according to claim 1, further comprising a pressure sensor arranged in an upper part of the pressure regulating chamber.

9. The system according to claim 1, further comprising a speed sensor arranged in the ink recirculation circuit.

10. The system according to claim 1, further comprising a liquid level sensor arranged in the pressure regulating chamber.

11. The system according to claim 1, further comprising ancillary means selected from insulation valves, stirring means, a purging circuit, an ink waste tank, a cleaning liquid tank and a filtering unit.

12. The system according to claim 1, further comprising a degassing cartridge arranged in the first ink conduit or in the second ink conduit of the recirculation circuit to extract dissolved gases from the ink.

13. The system according to claim 12, wherein the degassing cartridge comprises a degassing pump and a vacuum sensor.

14. A method for delivering ink to at least one printing module, comprising:

providing the ink delivery system recited in claim 1;

providing a continuous flow of the ink in the closed-loop ink recirculation circuit of the ink delivery system;

producing, by the vacuum discharge circuit of the ink delivery system, a vacuum condition in the at least one printing module, further comprising maintaining established backpressure in the pressure regulating chamber of the ink delivery system by the backpressure pump of the backpressure generating circuit of the ink delivery system.

* * * * *